United States Patent [19]

Campbell et al.

[11] 4,244,561

[45] Jan. 13, 1981

[54] AIRBORNE HOIST

[75] Inventors: Richard F. Campbell, Broomall, Pa.; Dennis Stein, Columbus, Ohio

[73] Assignee: The United States of America as represented by the Secretary of the Army, Washington, D.C.

[21] Appl. No.: 54,213

[22] Filed: Jul. 2, 1979

[51] Int. Cl.[3] ..... B66D 1/26

[52] U.S. Cl. ..... 254/288; 244/137 R; 242/157 R; 254/297; 254/901; 254/389; 254/266; 254/331; 254/333

[58] Field of Search ..... 254/184, 150 R, 186 R, 254/150 FH; 292/158.3, 158.2, 54 R; 244/3, 137

[56] References Cited

U.S. PATENT DOCUMENTS

| | | | |
|---|---|---|---|
| 1,850,440 | 3/1932 | Berger | 254/184 |
| 2,420,072 | 5/1947 | Foote | 254/184 X |
| 3,024,001 | 3/1962 | Worden | 254/150 R X |
| 3,510,107 | 5/1970 | Fidler | 254/184 X |
| 3,809,334 | 5/1974 | Beurer | 242/54 R |
| 3,870,255 | 3/1975 | Lemont | 254/150 FH |

*Primary Examiner*—Edward J. McCarthy
*Attorney, Agent, or Firm*—Nathan Edelberg; Robert P. Gibson; Norman L. Wilson, Jr.

[57] ABSTRACT

An improved airborne hoist for use in lifting a load, particularly by means of a helicopter, comprising a pair of rotatable drums, each drum being rotatable in an opposite direction, a drive unit intergeared through a series of shafts for providing rotation to the drums, a cable holding device, in the configuration of a supplemental drum surrounding each of the first said drums, and each cable holding device provided for rotating simultaneously in unison with the rotation of its respective drum, while at the same time being axially shiftable for providing a winding or unwinding of its held cable from a constant location. The pair of drums each hold, respectively, its own cable, thereby providing a pair of cables that furnishes an inherent safety factor in that a single mechanical failure of a drum does not result in a loss of its held load. The front end of each drum forms a housing for supporting the various reduction gearing providing for lessening the speed of rotation of the drums, and the same housing of a drum is closed by a bearing mounted plate or other structure, which is intergeared by means of another gear to the respective proximate end of its drum, with said plate interconnecting with a spring unit that provides support for this end of the drum and effectively dampens any vibrations generated by the hovering craft and prevents their transmission through the hoist and to the supported load.

21 Claims, 5 Drawing Figures

AIRBORNE HOIST

BACKGROUND OF THE INVENTION

This invention relates generally to a winch, and more specifically pertains to a high capacity hoisting system for use in a helicopter, and which incorporates dual drums, each having its own winch cable, thereby providing a margin of safety even in the event of a mechanical failure in one of the operating drums.

A variety of winch and hoist drive systems particularly for use in conjunction with the helicopter are available in the prior art. The use of the helicopter, over the past two decades, has become significantly important in both its military and commercial applications. Generally, one main advantage that has enhanced the utility of this craft has been its ability to lift significant loads to extraordinary heights, and it does so with the use of various hoisting means that can initially raise the load from the ground, before the helicopter undertakes some movement to the desired location for reimplacement of its carried load.

While the hoist contributing attributes of the helicopter in the manner as previously described has become significantly important in both, as before stated, the military and commercial applications, there are certain deficiencies in the available art type of mechanisms that render the usage of their structured hoists somewhat deficient, and in many instances, even hazardous of application. For example, most of the hoisting means available in the prior art include the use of a single winch having a single cable pay-out, and with the cable release being performed over the length of its supporting drum, which thereby automatically translates into a slight shifting momentum to the load itself, and in many instances even before it is raised off of the ground or other supporting structure. As a result of this, there is a tendency for the load being lifted by the helicopter to immediately begin to sway upon its release of contact with the ground, which can be extremely hazardous to any surrounding workers or property, as can be fully appreciated. In addition, in those particular prior art applications where the single point delivery system has been incorporated, usually the cable is yet unwound from a drum having some width, with the suspended cable passing through some form of a fairlead assembly for guiding its unwinding cable to a single point delivery. But, the use of various forms of guides for attaining this purpose has usually resulted in the exertion of significant stresses upon the delivered cable, frequently giving rise to fleet angle problems that either can cause the cable to undertake some rotation, and thereby passing on such movement to its suspended load, and at the same time effecting such inherent twisting stresses to the cable that the reverse bends imposed upon the cable can lead to its reduced life and rapid fatigue.

Certain of the foregoing problems can be found in the type of winch systems shown in the earlier United States patents to Beurer, et al., U.S. Pat. No. 3,809,334, and in the United States patent to Worden, et al, U.S. Pat. No. 3,024,001.

Another example of a prior art type of hoisting system is shown in the United States patent to Lemont, U.S. Pat. No. 3,870,255, but which prior art system is more concerned with the drive mechanisms incorporated within the hoisting system, rather than the fallsafe operations of the hoists, and its construction, itself, such as shown and presented in the current invention.

It is, therefore, the principal object of this invention to provide a hoisting system for a helicopter or other hovering craft and which incorporates a pair of oppositely rotating drums for use in simultaneously suspending a pair of cables for lifting purposes.

Another object of this invention is the provision of means for eliminating the usual twisting moments or other forms of undesirable stresses that are normally encountered by the cables of the available winch systems utilized in the hoisting art.

A further object of this invention is the application of an equalizing bar that eliminates the need for non-rotating type cables.

Another object of the invention is the operation of a hoist where its cables depart at one location, thereby eliminating any fleet angle problems and the use of complex level wind systems.

A further object of this invention is the provision of structural means for use in partially supporting the hoisting mechanism built into a helicopter, and which effectively dampens and cushions against any of the vibrations normally generated within the type of an operating and hovering airborne craft and preventing their transmission by means of the hoisting cable to its suspended load.

A further object of this invention is the use of a bearing mounted cable holding means that can simultaneously rotate with its supporting drum and also shift axially thereof so as to provide a constant location for the pay-out of each cable associated with this inventive hoist.

Another object of this invention is the provision of vibration dampening means that is incorporated and acts in conjunction with the speed reducer of this hoist so as to provide both control in the velocity of operations of the hoist while cushioning it against shock or other vibrations normally sustained during helicopter hovering.

A further benefit of this invention is the elimination of cable fatigue problems associated with the conventional type capstan winches.

These and other objects will become more apparent to those skilled in the art upon reviewing the summary of this invention, and upon undertaking a study of its preferred embodiment in view of its drawings.

SUMMARY OF THE INVENTION

This invention comprehends two major improvements in the construction and operation of an airborne hoist. These improvements are as follows:

a. The provision of a dual drum hoisting assembly with each incorporating a cable supporting means that can rotate simultaneously with the rotation of its respective drum, while at the same time undertaking axial movement relative therewith so that the multi cable pay-out will occur at a constant location; and b. The interconnection of a spring means to furnish partial support for each of the pair of counter rotating drums so as to effectively cushion against the transmittal of vibrations from the helicopter through the hoisting mechanism and to its load supporting cable.

This invention, as previously commented, includes a base structure that bearing supports a pair of drums for counter rotation, each drum having a cable supporting means in the form of a supplemental drum partially surrounding and being axially arranged therewith and having a disposition slightly exteriorly of the surface of the first mentioned drums. This cable holding means associated with each drum is supported by bearings for attaining uniform rotation simultaneously in the same direction of turn of its supporting drum, but at the same time is urged into axial movement relative to its support drum so that its held cable may attain the necessary feed-out, or rewinding, at a constant location with respect to the hoist assembly.

One end of each drum means is flared slightly outwardly, and then connects with an extension drum that normally houses within its interior the various reduction gearing providing for the controlled slower speed of rotation of each drum during operation of this airborne hoist. More specifically, a series of planetary gears are housed within this drum housing, and are driven by an axial shaft that is likewise driven in rotation by means of a drive unit, for attaining rotation of its mounted planetary gears and the internal gears affixed to the interior of the drum housing so as to provide for a controlled slower speed of rotation of the hoist and assembly during its functioning. The open end of the drum housing has bearing mounted therein a plate like structure, and which plate incorporates an extended arm which is pivotally connected with a spring means, and capable of limited movement with respect thereto, so that any vibrations encountered by the base structure and the helicopter itself will be significantly cushioned through the arrangement of this spring means, and its connecting plate, which partially supports each of the drums of this hoist. Another shaft connects with the aforesaid plate structure and also has rotatably mounted thereon another planetary gear, which in turn meshes with another internal gear provided within the drum housing, and thereby provides the means for furnishing partial support to each of the drums and in a manner which effectively dampens its exposure to any impacting forces or vibrations that are normally maintained and sustained by the helicopter during its operation, and in addition absorbs all the torque generated due to the loaded cable riding over their drums.

BRIEF DESCRIPTION OF THE DRAWINGS

In the drawings, FIG. 1 provides a partial longitudinal sectional view of the airborne hoist of this invention, further showing the reduction gearing mounted within the drum housing and having the cable supporting means and its drum fully supported by its base structure; with this view, by way of illustration, being taken approximately along the line 1—1 of FIG. 2.

DESCRIPTION OF THE PREFERRED EMBODIMENT

Figure 1:
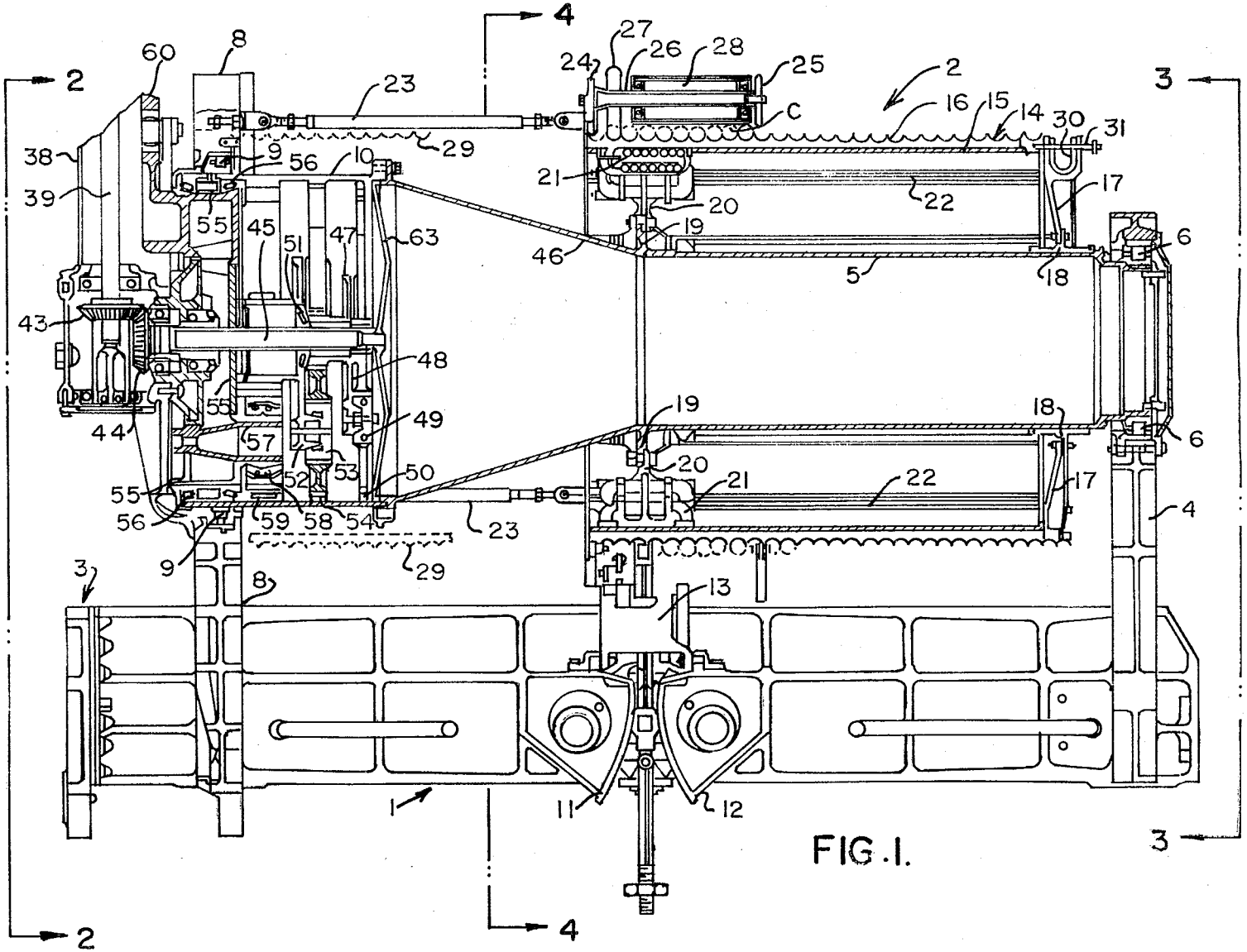
Figure 2:
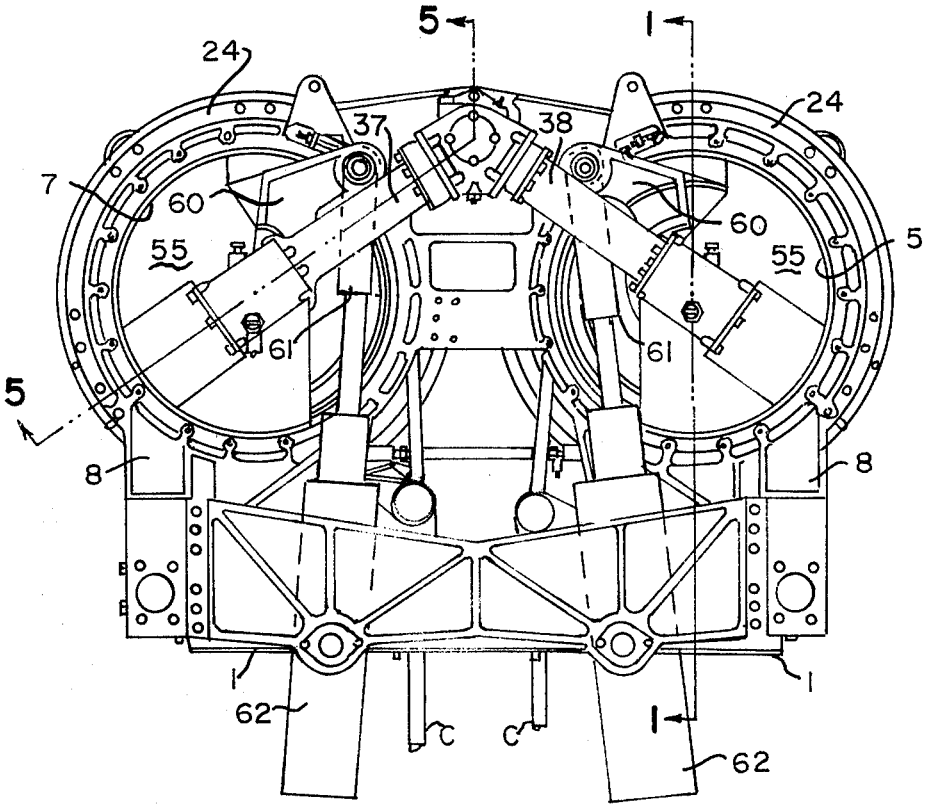
FIG. 2 furnishes a front end view of the hoist of this invention.

In referring to the drawings, and in particular FIG. 1, there is disclosed the airborne hoist of this invention which incorporates a base structure 1 having an overall length equal to or exceeding the length of the hoist assembly 2, with the base structure having, at what may be defined at its forward end 3, means for rigidly securing the said structure to the aircraft superstructure. Projecting upwardly from the approximate back end of the base structure 1 is an upright form of rigid structural means 4 that is useful for supporting the back end of the drums 5, and it can be seen that anti-friction bearings 6 are useful for providing a reduced frictional movement of each of the drums 5, in their support upon the upright structural means 4. As can be seen in FIG. 2, there are two such drums 5, and 7, provided in the airborne hoist assembly of this invention.

Further provided at the approximate forward end of the base structure 1 is another integral upright structural means 8, and which is provided for mounting by means of the bearings 9, the forwardly extending drum housing 10, and thereby providing near frictionless rotation of each of the drums 5 and 7 within their respective portions of the upright 8.

Provided approximately at the midpoint of the base structure 1, and extending approximately from side to side of the same, are the cable guides 11 and 12 which are useful for facilitating the proper positioning of the cables, there being one of each cable depending from each of the drums 5 and 7, as can be seen at C in FIG. 2, so that the cables can be conveniently positioned in parallel alignment in their depending downwardly in the direction of their supported lower load. An equalizing bar extending between the cables prevents their turning or twisting as when a load is being hoisted by means of this assembly. In addition, a cable cutter 13 is likewise provided within the distance between the approximate sides of the base structure 1, and normally has the cables C extending therethrough, so that in the event of an emergency, as when the craft is being jeopardized in its operations, and it must immediately jetison its load, the cable cutter 13 can be actuated for immediately slicing of the cables so as to abort its supported load, thereby freeing the helicopter, or other airborne craft, for immediate flight.

Figure 3:
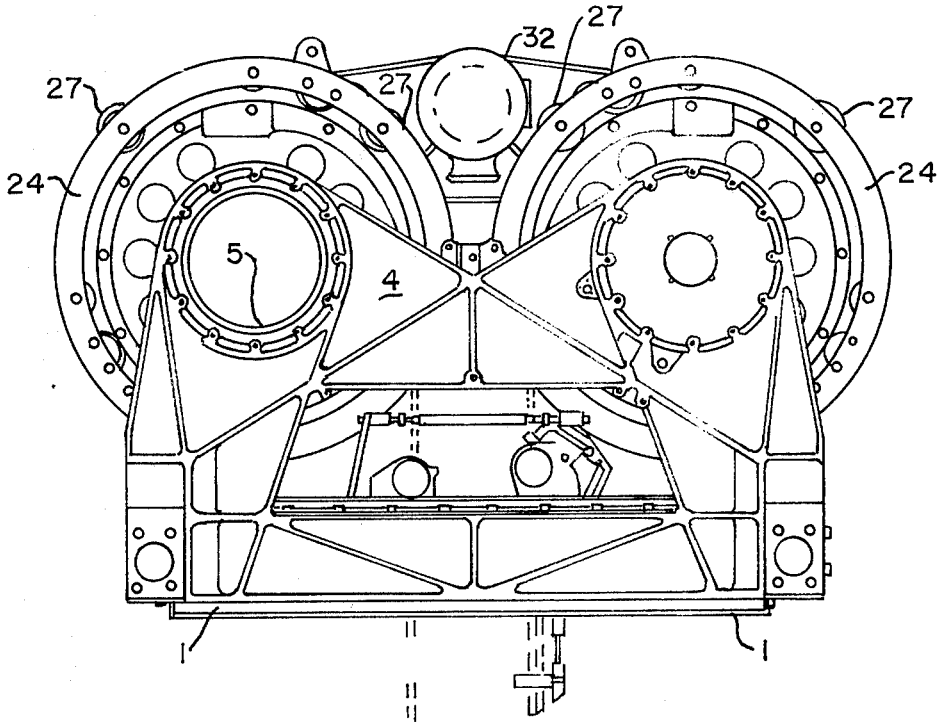
FIG. 3 provides a back end view of the hoist assembly of this invention.

As can also be seen in FIGS. 2 and 3, the base structure 1 extends the approximate full width of the hoist, and the uprights 4 and 8 are of sufficient heighth to provide the means, as previously explained, for bearing mounting of the pair of drums and their extended drum housings.

Provided for further functioning upon each drum 5 is the carriage assembly 14, 15 and 16 of this invention. It comprises a form of cable holding means, one being associated with each drum, so as to provide for the pay-out or retraction of their respective cables, during simultaneous operation, as during employment of the hoist. Each cable holding means comprises drum-like structure 15, which is formed having an integral arranged helical surface 16, which provides a two-fold purpose; one for furnishing a convenience seat for the proper positioning of the single layer of cable as it is being wound or unwound from the drum, and secondly, as will be subsequently described, provides the cooperative means for furnishing axial shifting of the cable holding means 15 longitudinally of its supporting drum 5, so as to furnish the means for attaining the pay-out of the cable always at a constant location relative to the hoist structure and directly above the guides 11 and 12, as previously explained.

Figure 4:
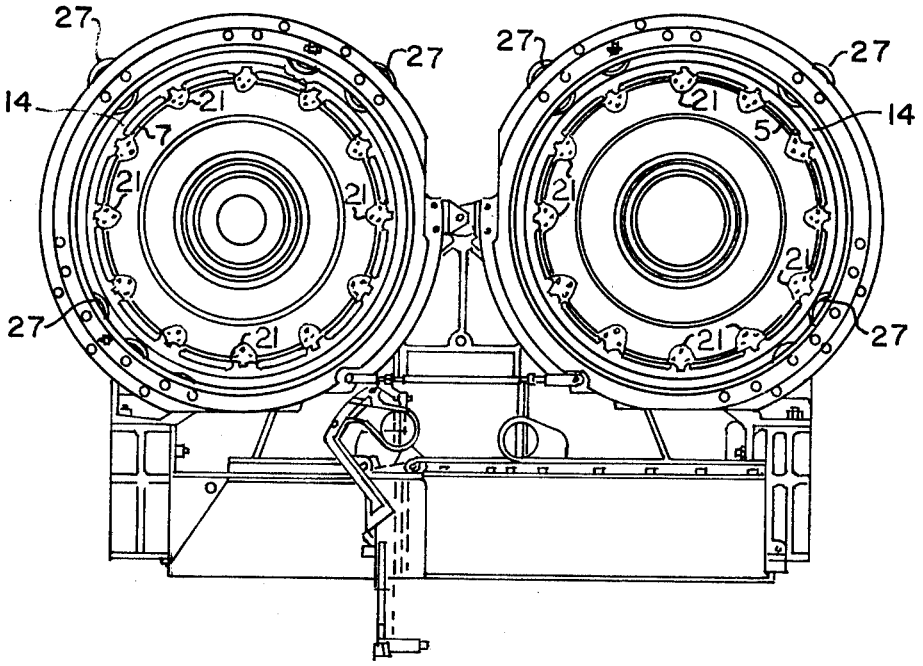
FIG. 4 furnishes a horizontal sectional view of the airborne hoist taken along the line 4—4 of FIG. 1.

The rearward end of the cable holding means 14 is provided with inwardly directed radially disposed structure 17 which has secured to its innermost ends a slide bearing 18, arranged for resting around the outer circumference of the drum 5, so as ot provide means for stably supporting the cable holding means at this position, and at the same time, allowing for the axial sliding of the said means with respect to its respective supporting drum 5. At the approximate opposite end of the drum 5 is a flange 19 which has secured to it a series of bearing supports 20, with each bearing support designed for holding a linear recirculating ball bearing unit of the type that allows for shifting of one object, such as the cable holding means drum 15, with respect to the supporting drum 5. And, as can be further seen, the inner surface of the cable holding means drum 15 is formed having a series of longitudinal grooves, as at 22, provided along its length, with one set of each grooves being provided for matching with each one of the linear recirculating ball bearing units, so that the exposed ball bearings at their upper sides will be conveniently disposed within a respective groove formed within the inner surface of the drum 15, as previously explained. Thus, when the drum 5 rotates, the bearing units 21, being disposed within the respective grooves 22, will also effect a simultaneous rotation of the cable holding means 14 therewith. But, when the said cable holding means 14 commences to shift axially of the drum 5, it will be allowed to do so because the bearings 21 will ride within their respective grooves 22 of the cable holding means drum 15, and the sliding bearings 18 will accommodate such movement at the opposite end of the drums. It can also be seen from FIG. 4 that there are approximately 12 sets of these linear recirculating ball bearing units 21 projecting from each of the drums 5 and 7, respectively, and which are located within corresponding longitudinal grooves formed within the inner surface of each of the said cable holding means 14 of this invention.

The means for attaining the axial shifting of the cable holding means 14, and its inherent drum 15, with respect to the drums 5 and 7, respectively, of this hoist assembly is attained as follows. The upwardmost portion of the upright structural means 8 is formed having a series of locating arms 23, which arms are designed for securing an annulus 24 around the proximate end of the cable holding means 14, and a shaft is provided intermediate this annulus 24, and another annulus 25, with this shaft 26 being disposed for supporting for rotation, but at a stationary position, the profiled rollers 27. A hold down roller 28 is provided for securing this structure proximate the surface of the drum arranged cable C, as can be seen, and at the same time it insures the proper positioning of the roller 27 within the helical groove 16 at all times. Thus, when the drum 5 is rotated, and which likewise through its bearing means 21 effects a simultaneous rotation of its cable holding means 14, stationary profiled rollers 27 will ride within the cable holding means helical groove, and as rotation continues, the effects of the roller 27 within the groove causes a gradual axial shift of the said means 14 along the length of the said drum 5. Thus, the cable will be unwound, or wound, from the cable holding means 14 always at one location relative to the hoist structure, due to this gradual shift of the means 14, and its adjustment in a manner that depends its cable downwardly at a location just below the contiguous hold down rollers 28. And, as can be further seen in hidden line, as shown within FIG. 1, as the pay-out of the cable reaches the end of the cable length, the cable holding means 14 will have achieved a forwardmost reach of its axial shift to the front of its supporting drum 5, as can be seen in hidden line at the location 29. Thus, at this stage of its operation, almost all of the cable has been fed out of the hoist assembly.

It may also be commented that to insure that the cable will not totally disengage from its suppporting means 14, the proximate back end of the cable supporting means, and more specifically its radial supporting structure 17, is integrally formed at one location having a U-shaped slot 30, with an accompanying pin 31, and to which the end of the cable may be secured so as to prevent its disengagement from the same.

Figure 5:
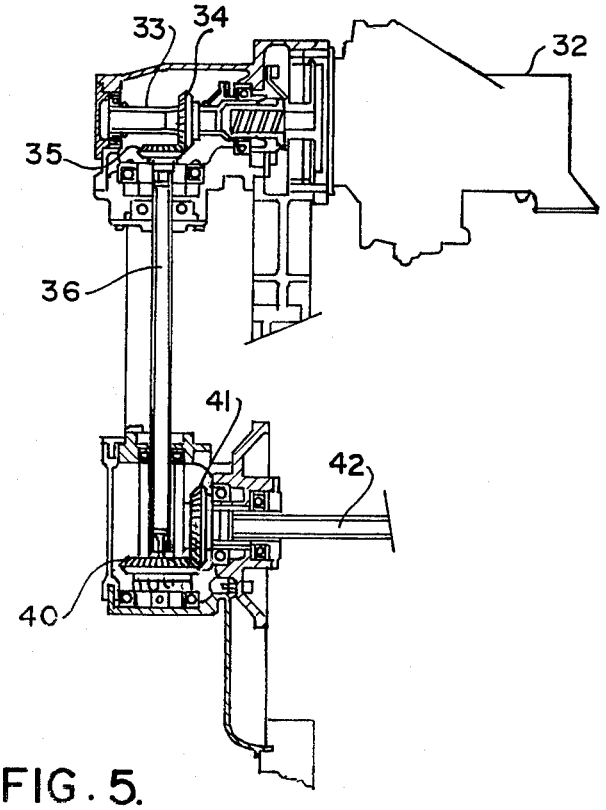
FIG. 5 furnishes a sectional view of part of the drive shaft assembly of this invention, taken along the line 5—5 of FIG. 2.

The means for powering the operation of this airborne hoist may be described as follows. A drive unit, such as any form of motor means, such as a variable speed DC motor, but in the preferred embodiment, comprising an air turbine motor 32, is further supported upon the base structure of this hoist. See also FIG. 5. This motor may function, as in the preferred embodiment, at approximately 4000 rpm. The motor extends its shaft 33 for rotation, and its mounted beveled gear 34 intermates with another bevel gear 35 that connects upon a drive shaft 36 that extends downwardly in an angular direction toward the center of one of the drums of this hoist assembly, in this particular instance, to the drum 7. Actually, and as can also be determined from FIG. 2, there are two such bevel gears 35 that mate with the motor connected bevel gear 34, and their respective drive shafts extend downwardly at an angle within their respective housings 37 and 38 for disposition of their said respective drive shafts proximate the center of each of the drums 5 and 7, as can be seen. For example, and as also shown and explained in FIG. 5, the drive shaft 36 extends downwardly within its housing 37 for disposition proximate the center of the drum 7, for the purpose of attaining its rotation. At the same time, the drive shaft 39 extends downwardly angularly for a distance within its housing 38 for disposition of its lower end proximate the center of the drum 5. (See FIG. 1, once again). Thus, each of the drive shafts 36 and 39 are driven through their respective bevel gears by the same bevel gear 34 formed upon the shaft 33 of the air turbine motor 32. But, it is essential that in order to attain feed out of their respective cables C from each of the drums 5 and 7, or more specifically their cable holding means, as at 14, with these cables being released at a position within the space formed intermediate the two drums 5 and 7, as can be seen in FIG. 2, it becomes essential that each of these drums 5 and 7 must undertake rotation in opposite directions with respect to each other. To achieve this, the drive shaft 36 is formed having another bevel gear 40 provided at its more distant end, and it is arranged to the approximate underside of the bevel gear 41 associated with the axial shaft 42 used for rotation of the drum 7. Alternatively, the drive shaft 39 has rigidly connected to it a bevel gear 43 which intermates with another bevel gear 44 at a position above the said latter gear, as distinct from the positioning of the previously explained bevel gear 40, and this bevel gear 43 associated with the drive shaft 39 is intermated with said gear 44 for effecting a rotation of the axial shaft 45 that is useful for stimulating rotation of its associated drum 5. Thus, and as can be understood, the unique positioning of these bevel gears 40 and 43 with the respective drive shafts 36 and 39, and their engagement with their respective gears 41 and 44, at opposing locations, effects a simultaneous but opposite rotation of their respective drums 5 and 7, thereby attaining a pay-out of their various cables C simultaneously.

Obviously, various conveniently located bearings, as can be seen, are provided for mounting of the motor shaft 33, the various drive shafts 36 and 39, and the axial shafts 42 and 45, so as to furnish their near frictionless rotation during operations of this hoist assembly.

With the air turbine or other form of motor 32 revolving at speeds in the vicinity of 4000 rpm, it is necessary to provide some form of reduction gearing for lessening this speed so that the drum 5 and 7, and their associated cable holding means, will revolve at a much greater reduced speed. Thus, and referring once again to FIG. 1, the drum 5 is formed having a flared portion 46 that is secured with the drum housing 10. Obviously, the drum 7 is constructed in an equivalent manner. Various reduction gearing may be provided within the drum housing 10, and many such reduction gearing assemblies are available upon the market, and which could be used for significantly reducing the speed of rotation of the various axial shafts 45 and 42, so as to effect a much lesser speed of rotation of their respective drums 5 and 7, as aforesaid. Generally, and in the preferred embodiment, it is desirable to utilize a 400 to 1 reduction ratio from the speed of the motor to the revolving of its respective drums 5 and 7.

Once again, in the preferred embodiment, the use of planetary gears has been made for attaining this speed reduction. As can be seen in FIG. 1, the axial shaft 45 has secured through the agency of a sun gear 47 a gear supporting structure 48 which is useful for holding the planet gear 49, and which gear mates with an inner gear 50 formed or connected upon the inner surface of the housing 10. This forms a first stage planetary gear in the speed reducing system for this invention.

Also connected for rotation with respect to the axial shaft 45 is another sun gear 51, and which is disposed for rotating its connected frame 52 which in turn supports the planetary gear 53 which is intermated with the inner gear 54 also formed upon the interior surface of the housing 10. And, this forms the second stage planetary gear system of the speed reduction means for this invention. These two previously described planetary gears 53 and 49, as integeared with their respective internal gears 50 and 54, together with their reduction through the planetary gear system described hereinafter, provide for the substantial speed reduction of the drums 5 and 7 to the approximate velocity as previously explained.

There is also provided in this invention the means for cushioning or dampening of the transmittal of vibrations and provides shock insulation from the operating aircraft to the hoist assembly and its cable suppported load. And likewise, as previously explained, such also is provided for absorbing the torque generated by the loaded cables riding upon their drums. This is achieved also through the use of a planetary gear structure, which indirectly provides support for each of the drums 5 and 7 as follows. The end of the housing 10 of each of the drums 5 and 7 is normally open. But, a plate like or other type of frame structure 55 is disposed for slight pivoting within this open end of the housing, and is bearing mounted thereto by means of a series of bearing 56. And, the approximate lower end of the plate 55 is provided with an integral shaft 57 upon which is bearing mounted another planetary gear 58. Gear 58 is also intergeared with an internal gear, 59 formed upon the interior surface of the housing 10. Gear 58 meshes with a sungear which is mounted on gear carrier 52. Thus, some support for the drum 5 is furnished through this arrangement of the plate 55, and its associated planetary gear 58, in the manner as explained. The upper end of each drum associated plate 55 is integrally formed having an arm 60, and it can be seen that such an arm 60 is formed with each of the plates 55 spanning the open ends of each of the drums 5 and 7, as can also be seen in FIG. 2. These arms 60 are designed for pivotally connecting with the rods 61 that extend into the cylinders 62 that form a type of spring unit useful for absorbing any of the shock, torque, or even vibrations, that generally prevail throughout an operating helicopter and its hoist, mainly through this described unique positioning of the plate 55 as bearing mounted within the drum housing 10, and further arranging their planetary gears 58 intergeared within the interior of the same said drum housing 10, of each of the drums 5 and 7. The cylinder portions 62 of each of the spring units may comprise a form of liquid spring or hydraulic shock absorber type of dampening means, with said cylinders being rigidly connected either to the base structure 1, or even to the structure of the helicopter frame. It any event, the rods 61 are piston or otherwise mounted within the cylinders for eliminating the transmittal of any vibrations from or to the aircraft. And, as can be seen, any slight extension or retraction of the rods 61 with respect to their cylinder 62 may achieve a slight pivotal movement to their pivotally connected arms 60, and consequently the plates 55, but such can be accommodated due to the latter's bearing mounting within the open end of the each said housing 10, of each drum, as previously explained.

A diaphragm 63 provides closure for the inner end of each drum housing 10.

Variations in the construction and operation, and even the type of component parts, as built into the fabricated airborne hoist assembly of this invention may occur to those skilled in the art upon reviewing the subject matter of this disclosure. The description of this preferred embodiment is set forth for illustrative purposes only, and any such variations in its construction if encompassed within the spirit and scope of this invention, are intended to be protected by any claims to patent protection issuing upon the same.

Having thus described the invention what is claimed and desired to be secured by Letters Patent is:

1. An airborne hoist for lifting a load and comprising a pair of rotatable drums for use in providing feed out of a pair of cables for use in the lift procedure, a base structure supporting said drums for rotation in opposite directions, a drive unit, said drive unit when energized providing for rotation of said drums in their opposite directions of rotation, a cable holding means supported by each drum and each capable of both rotating in unison with the rotation of its respective supporting drum and for simultaneously shifting axially a distance along the length of its drum during rotation, one of each cable being wound on each cable holding means and each capable of being simultaneously wound or unwound during a lifting operation.

2. The invention of claim 1 and wherein said cables are wound or unwound at constant locations from their respective cable holding means during drum rotation.

3. The invention of claim 2 and including bearing means supporting each cable holding means upon its respective drum and facilitating the simultaneous axial movement of the said means during drum rotation.

4. The invention of claim 3 wherein one of said bearing means includes at least one sliding bearing located proximate one end of the cable holding means, said sliding bearing being contiguous with the surface of the surrounded drum and for sliding longitudinally therealong.

5. The invention of claim 3 wherein one of said bearing means includes a series of linear recirculating ball bearing units mounted upon the drum, said cable holding means having a series of longitudinal grooves arranged upon its interior, the bearings of each unit being arranged within a respective groove, whereby the rotation of a drum effects through its bearing units a simultaneous rotation of its held cable supporting means while further facilitating its axial movement with respect thereto.

6. The invention of claim 3 wherein each cable holding means includes a helically formed groove arranged upon its outer surface, a cable ordinarily being arranged within waid groove and capable of being wound or unwound therefrom upon rotation of its combined cable holding means and its supporting drum.

7. The invention of claim 6 and including at least one roller means stationarily positioned with respect to said cable holding means, said roller means disposed for riding within the said helically formed groove, whereby the rotation of said cable holding means further translates into its axial movement through the cooperation of said roller means within the contiguous helical groove.

8. The invention of claim 3 and including vibration absorbing means associated with the said drums and for use in dampening the transmittal of any vibrations from or to the base structure and the cable holding means and its suppported load.

9. The invention of claim 8 wherein said vibration absorbing means includes a spring means operatively associated with one end of each drum.

10. The invention of claim 9 and wherein each drum is open at its forward end, a structural means bearing mounted within the open end of said drum, said spring means being connected with said means, wherein during drum rotation each drum is partially supported at its open end by the said spring mounted structural means.

11. The invention of claim 10 and including a shaft projecting from said structural means, and a planetary gear rotatably mounted upon said shaft and intergearing within the proximate open end of the said drum to furnish further vibration dampening contact between the drum and its base structure.

12. The invention of claim 3 wherein each drum has a gear housing area proximate one end, there being at least one speed reducing gear provided within said end of the drum and interconnecting between the drive unit and its proximate drum to furnish a slower speed of rotation for the hoist than the revolutions of the drive unit.

13. The invention of claim 12 and wherein said speed reducing gear comprises a planetary gear, there being an internal gear provided upon the interior peripheral surface of the drum for each planetary gear, said planetary gear intermeshing with its respective internal gear for furnishing the said slower speed of rotation for the said pair of drums.

14. The invention of claim 13 wherein there are three sets of planetary and internal gears provided within the end of each drum.

15. The invention of claim 14 and including a pair of drive shafts, one of each drive shaft connecting between the drive unit and one of each rotatable drum, each drum including an axial shaft aligned therein and geared to its respective drum associated drive shaft, said axial shaft furnishing the force for driving the said planetary gears and drums in rotation.

16. The invention of claim 15 and including a series of bevel gears interconnecting between the drive unit, the pair of drive shafts, and the axial shafts of each drum, and said bevel gears furnishing the means for effecting the rotation of said drums in opposite directions.

17. The invention of claim 16 and including vibration absorbing means associated with the said drums and for use in dampening the transmittal of any vibrations from or to the base structure and the cable holding means and its supported load.

18. The invention of claim 17 and wherein said vibration absorbing means includes a spring means operatively associated with one end of each drum.

19. The invention of claim 18 and wherein each drum is open at its forward end, a structural means bearing mounted within the open end of each drum, said spring means being connected with said structural means, wherein during drum rotation each drum is partially supported at its open end by the spring mounted plate.

20. The invention of claim 19 and including a shaft projecting from the said structural means, and a planetary gear rotatably mounted upon said shaft and intergearing within the proximate open end of the said drum to further furnish vibration dampening contact between each drum and its base structure.

21. The invention of claim 20 and wherein the said axial shaft of each drum extends through the structural means operatively associated with each open end of a drum.

* * * * *